US007113102B2

(12) United States Patent
Soemantri

(10) Patent No.: US 7,113,102 B2
(45) Date of Patent: Sep. 26, 2006

(54) SYSTEM HAVING A SCREEN AND AN EXTERNAL POWER SUPPLY UNIT

(75) Inventor: Albertus Soemantri, Friedberg (DE)

(73) Assignee: Fujitsu Siemens Computers GmbH, Munich (DE)

( * ) Notice: Subject to any disclaimer, the term of this patent is extended or adjusted under 35 U.S.C. 154(b) by 423 days.

(21) Appl. No.: 10/715,022

(22) Filed: Nov. 17, 2003

(65) Prior Publication Data

US 2004/0100462 A1 May 27, 2004

(30) Foreign Application Priority Data

Nov. 15, 2002 (DE) ..... 102 53 386

(51) Int. Cl.
*G08B 21/00* (2006.01)

(52) U.S. Cl. ..... 340/635; 340/693.1; 323/282; 324/133; 324/539; 324/711; 714/43

(58) Field of Classification Search ..... None
See application file for complete search history.

(56) References Cited

U.S. PATENT DOCUMENTS 5,570,002 A * 10/1996 Castleman ..... 323/283
6,054,846 A * 4/2000 Castleman ..... 323/283
6,842,868 B1 * 1/2005 Brown et al. ..... 714/43
6,913,477 B1 * 7/2005 Dayan et al. ..... 439/188
2002/0113907 A1 8/2002 Endo et al.
2004/0082369 A1 * 4/2004 Dayan et al. ..... 455/573

FOREIGN PATENT DOCUMENTS

| | | |
|---|---|---|
| DE | 37 44 733 C2 | 2/1989 |
| JP | 2002-41188 | 8/2002 |
| JP | 2002-108513 | 12/2002 |
| KR | 1999-006180 | 2/1999 |
| KR | 2002-0001074 | 1/2002 |

* cited by examiner

*Primary Examiner*—Benjamin C. Lee
(74) *Attorney, Agent, or Firm*—Laurence A. Greenberg; Werner H. Stemer; Ralph E. Locher

(57) ABSTRACT

A system having a screen, in particular a flat screen, and having an external power supply unit that can be connected by a plug connector to the screen in order to supply the screen with a DC voltage. The system provides a signaling device at the power supply unit end and a comparator at the screen end for comparison of the operating parameters of the power supply unit with nominal operating parameters. A fault signaling device is provided for indicating unacceptable discrepancies between the signaled operating parameters and the stored operating parameters.

13 Claims, 1 Drawing Sheet

SYSTEM HAVING A SCREEN AND AN EXTERNAL POWER SUPPLY UNIT

BACKGROUND OF THE INVENTION

Field of the Invention

The invention relates to a system having a screen, in particular a flat screen, and having an external power supply unit that can be connected by a plug connector to the screen in order to supply the screen with a DC voltage.

Systems such as these have a screen and an external power supply unit. External power supply units are used in particular for flat screens, since they can be operated at low voltages of, for example, 12 V, 14 V, or 16 V. The external power supply units are connected on the one side to the electrical power supply network, whose voltage is normally 230 V or 110 V, while, on the other side, there is a two-wire connection to the screen, with this cable being connected to the screen via a plug connection, so that the power supply unit and the screen can be disconnected in a simple manner.

In addition to screens, there are also a large number of other appliances that are supplied with a suitable operating voltage via such external power supply units, such as notebook computers, external CDROM drives, PDAs, scanners, and many more. The majority of these appliances are connected to the power supply unit via plug connectors of the same type. This therefore does not ensure that the only screens and power supply units that can be used with one another are those that are also suitable for joint operation. Most power supply units also have a very similar visual appearance, so that confusion can easily occur. For example, in the case of flat screens, it is possible for a screen to be delivered with a power supply unit and also to be connected correctly on initial installation.

When the flat screen is replaced, irrespective of whether this is because of a technical defect or because the user is changing his workstation or else receives a new or more up to date flat screen, flat screens will be used with the old power supply unit. From a purely mechanical point of view, the plugs of the power supply units can also be inserted without any problems in the new appliance, even though they are not electrically compatible.

Many users who are not technically experienced do not know or are unaware that a power supply unit has specific operating parameters that must match the operating parameters of the screen in order to ensure fault-free operation in the long term. As mentioned initially, flat screens normally use 12 V, 14 V, and 16 V. If a power supply unit with a rated voltage of 12 V is used together with a flat screen that is configured for 16 V, then the screen also attempts to cope with this lower voltage, even though this does not ensure long-term fault-free operation. On the other hand, when a power supply unit with an excessively high voltage is used in the long term, this can lead to destruction of individual assemblies in the screen. Since neither of these faults can be identified immediately and they are generally not noticed until later, a technical screen defect is assumed, and a claim is made on this basis. It is therefore also in the interests of the screen manufacturer for only associated appliances to be used with one another.

Another operating parameter is the maximum load capacity of the power supply unit. Since different appliances also draw different currents, the power supply units are also fabricated for the respective maximum power consumption. When using a power supply unit that cannot provide adequate power, the power supply unit is generally overheated and, after a certain time, this leads to destruction of the power supply unit. In this case as well, the manufacturer is held to be responsible for a technical fault that has never occurred, since all that has happened is that the appliances have been combined incorrectly.

However, the use of an incorrect power supply unit is problematic for a third reason, as well. The power supply units that are used are switched-mode power supply units that operate at a high frequency. From the point of view of electromagnetic compatibility (EMC) they must therefore be regarded as potential interference sources. Interference sources such as these are subject to strict regulations, whose compliance must be verified by the manufacturer. The connecting cable between the power supply unit and the screen in this case acts as an antenna. In order to ensure that radio-frequency currents are attenuated optimally, the impedances and characteristic impedances of the power supply unit, of the cable and of the screen must be optimally matched to one another. If a screen is used with a power supply unit that is not suitable, these appliances become an interference source and can lead to interference with other appliances.

SUMMARY OF THE INVENTION

It is accordingly an object of the invention to provide a system having a screen and an external power supply unit that overcomes the hereinafore-mentioned disadvantages of the heretofore-known devices of this general type and that ensures that the screen is operated only with a suitable power supply unit.

With the foregoing and other objects in view, there is provided, in accordance with the invention, a system of the type mentioned initially that is distinguished in that the power supply unit has devices for signaling operating parameters, and the screen has comparison devices (i.e. a comparator) for comparison of signaled operating parameters with stored operating parameters. Fault signaling devices are connected to the comparator and indicate unacceptable discrepancies between the signaled operating parameters and the stored operating parameters.

The advantage of the system according to the invention is that unsuitable power supply units are identified in a simple manner, with only a small number of additional apparatuses being required for this purpose, which do not significantly increase the production costs. If the signaling takes place via the two conductors that are provided for the power supply, the same cables and plugs can be used as those that have been used until now. Even in the situation where the voltage that is provided by the power supply unit is too low, this is generally always sufficient in order to output a fault signal, for example via a loudspeaker or a light-emitting diode.

In a more convenient refinement, a so-called on-screen display (OSD) is provided as the fault signaling device, which is generally present in any case in order to adjust the operating parameters of the screen, such as the brightness or the position setting.

Virtually all of the commercially available screens have a microprocessor that can carry out fault evaluation without additional hardware being required for this purpose. All that is required is software matching to the additional tasks.

In one particularly suitable refinement of the invention, the signaling is carried out by using AC voltage signals that are superimposed on the DC voltage and contain modulated information about the operating parameters. In this case, a demodulator must be provided in the screen, in order to demodulate the signaling. The decoding and further processing, including the comparison with the stored operating parameters, are then carried out via the microprocessor for the screen. However, analog evaluation of signaled parameters is also possible.

It is particularly advantageous for the signaling to be restricted to a short time period after the initial setting up of the screen with the power supply unit, thus avoiding further EMC problems, since the relevant guidelines apply only to steady-state operation.

In another advantageous refinement, the screen also has a signaling device that can transmit information or a control signal to the power supply unit. For example, this makes it possible to use the screen to adjust power supply unit operating parameters.

Other features that are considered as characteristic for the invention are set forth in the appended claims.

Although the invention is illustrated and described herein as embodied in a system having a screen and an external power supply unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
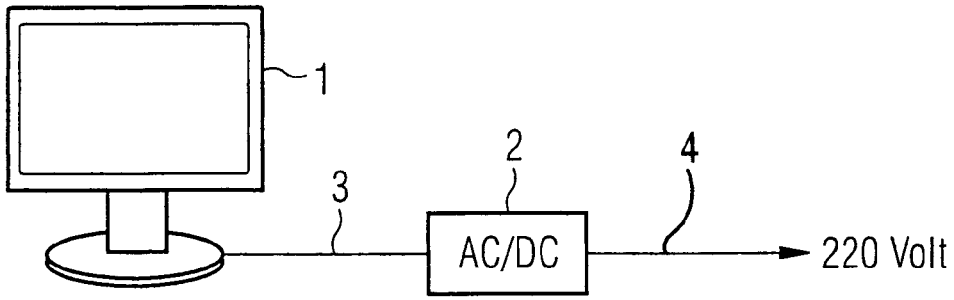
FIG. 1 is a partial diagrammatic and partial schematic view showing a configuration of a screen with an external power supply unit.

Referring now to the figures of the drawings in detail and first, particularly to FIG. 1 thereof, there is shown a typical configuration of a flat screen 1 and a power supply unit 2, which are connected to one another via a cable 3. The power supply unit is furthermore connected via a further cable 4 to the electrical mains system that, for example, provides a voltage of 230 V.

The cable 3 between the power supply unit 2 and the flat screen 1 could in this case act as an antenna, via which interference frequencies are transmitted. The cable 3 is connected to the flat screen 1 via a plug connector 5.

Figure 2:
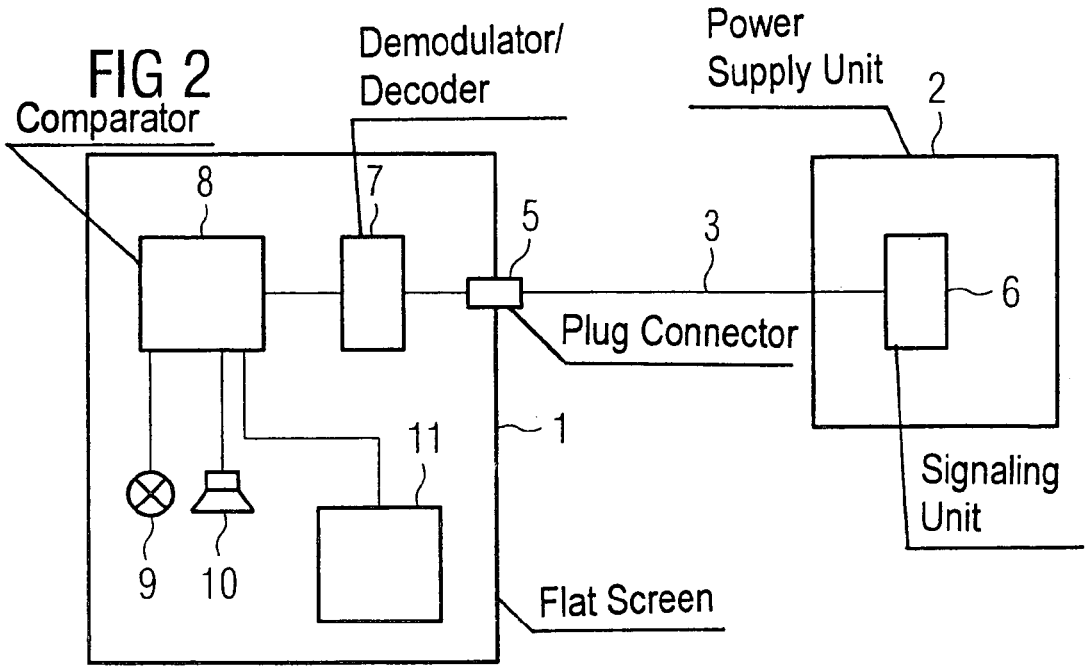
FIG. 2 is a schematic view showing functional units of the screen and the power supply unit.

FIG. 2 shows the functional units of the configuration from FIG. 1. The power supply unit 2 has a signaling unit 6 that, after connection of the power supply unit 2 to the electrical mains system and the initial setting up of a flat screen 1, signals operating parameters to the flat screen 1. The operating parameters include the voltage, the load capacity, and the type of power supply unit 2. The flat screen 1 has a demodulator/decoder 7 that outputs the transmitted information and processes it. The demodulator/decoder 7 is connected to a comparator 8. The comparator compares the transmitted information with stored values. The comparator 8 finds out whether operation with the connected power supply unit 2 is permissible. If the comparator 8 finds that this is not permissible, it emits a signal that indicates the fault via fault signaling device (FSD) 9, 10, or 11. Suitable fault signaling devices include a light-emitting diode 9, a loudspeaker 10, or else a display on a display unit 11 that normally reproduces the image that is to be displayed and is transmitted from a connected computer. This is preferably done by using the device that control the so-called on-screen display, in order to set parameters for the screen display.

It is not necessarily mandatory for all of the described fault signaling devices 9, 10, and 11 to be provided. However, it is invariably advantageous for one of the fault signaling devices to be suitable for the purpose of signaling a fault even when the available operating voltage is not sufficient to operate the display unit 11.

If the voltage that is provided is considerably too high, it may be necessary to switch the display unit 11 off for safety reasons, in order to prevent it from being damaged, while a light-emitting diode 9 or a loudspeaker 10 can still be operated without any problems from the excessive voltage. For example, when using a light-emitting diode 9, it would be possible for a user to be made aware of the presence of the fault by producing an ever greater blinking frequency.

Particularly in the case of an excessively high voltage, it is possible to use a combination with conventional voltage monitoring devices that operate without the inclusion of the microprocessor and allow the light-emitting diode or the loudspeaker to be operated directly.

FIG. 2 does not show how signaling could take place in the opposite direction. A signaling apparatus would be required at the flat screen 1 end for this purpose, in order to transmit information via the same line as the signaling from the power supply unit 2 to the flat screen 1. This could be done, for example, by providing a different frequency, so that the first and the second frequency are superimposed and the power supply unit 2 or the flat screen 1 filters out that frequency which contains the information that is intended for it.

Figure 3:
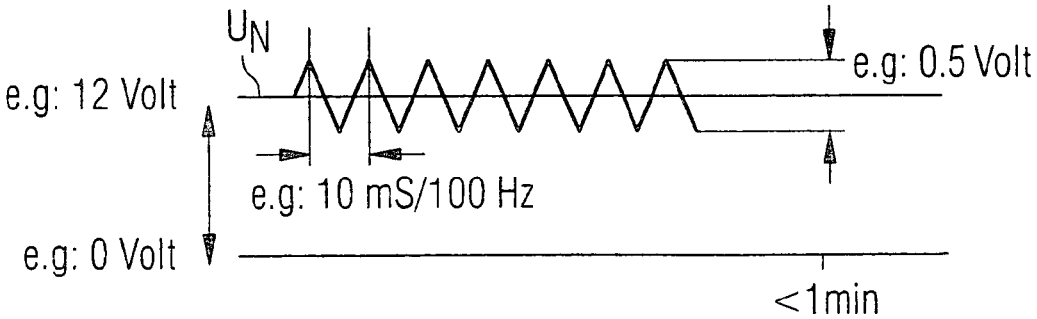
FIG. 3 shows a signaling diagram of information transmission from the power supply unit to the screen.

FIG. 3 shows a signaling diagram illustrating the procedure at the start of operation. In the present case, it is assumed that the voltage $U_N$ supplied from the power supply unit 2 is 12 V. An AC voltage is superimposed on this to contain the modulated information that is intended to be transmitted. The illustrated sawtooth voltage, although a sinusoidal voltage or else a square-wave voltage could also be used, has an amplitude of 0.5–1.2 V. This therefore has no adverse effect on the actual operation of the screen. The signaling is carried out, for example, in the first seconds of operation. The presence of the superimposed AC voltage in this case means, for example, a logic 1, or the absence of a superimposed AC voltage means a logic 0. The information is in this case concealed in the transmitted bit sequence. However, many variants of this are possible that those skilled in the art will be familiar with and which can be chosen in the respective application. In this case, in particular, it is possible to use an association between the information and a specific frequency or a specific amplitude.

The frequency of the modulated AC voltage in the illustrated case is 100 Hz, corresponding to a period duration of 10 ms.

It is, of course, also necessary to consider the situation in which the screen according to the invention is operated with a conventional power supply unit, in contravention of the regulations. In order to indicate a fault in this situation as well, the comparator and the fault signaling device are set up to indicate a fault when there is no signaling of operating parameters from an external power supply unit on initial startup.

I claim:

1. A system, comprising:

a screen having a plug connector;

an external power supply unit connected to said screen by said plug connector to supply said screen with a DC voltage and having a signaling device for signaling operating parameters;

a comparator of said screen comparing the signaled operating parameters with stored operating parameters; and a fault signaling device connected to said comparator for indicating unacceptable discrepancies between the signaled operating parameters and the stored operating parameters.

2. The system according to claim 1, wherein said screen is a flat screen.

3. The system according to claim 1, wherein said signaling device superimposes AC voltage signals on the DC voltage, the AC voltage signals containing modulated information relating to the signaled operating parameters.

4. The system according to claim 1, further comprising a demodulator for demodulating the signaled operating parameters.

5. The system according to claim 1, wherein said signaling device only signals when said screen and said power supply unit are initially started.

6. The system according to claim 5, wherein said signaling device only signals within a time period less than one minute after said screen and said power supply unit are initially started.

7. The system according to claim 1, wherein said fault signaling device makes an audible signal.

8. The system according to claim 1, wherein said fault signaling device makes a visual signal.

9. The system according to claim 1, wherein said fault signaling device make a visual signal on said screen.

10. The system according to claim 1, wherein the signaled operating parameters include a voltage and a maximum load capacity.

11. The system according to claim 1, wherein said fault signaling device is configured to provide screen operating parameters from said screen to said power supply unit.

12. The system according to claim 11, wherein said power supply unit adjusts the operating parameters based on the screen operating parameters being received.

13. A screen for a system having an external power supply unit connected to the screen for supplying the screen with a DC voltage, the screen comprising:

a comparator adapted to compare signaled operating parameters with stored operating parameters;

a plug connector coupled between the external power supply unit and said comparator, said plug connector adapted to transmit the operating parameters from the external power supply unit to said comparator;

a fault signaling device connected to said comparator and adapted to indicate unacceptable discrepancies between the signaled operating parameters and the stored operating parameters; and said comparator and said fault signaling device indicating a fault when the external power supply does not signal the operating parameters during initial set up.

* * * * *